US011256186B2

(12) United States Patent
Shimozawa et al.

(10) Patent No.: US 11,256,186 B2
(45) Date of Patent: Feb. 22, 2022

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Hideharu Shimozawa, Numazu (JP); Tsutomu Nishida, Mishima (JP); Atsushi Okuda, Yokohama (JP); Yuka Ishiduka, Suntou-gun (JP); Kenichi Kaku, Suntou-gun (JP); Nobuhiro Nakamura, Numazu (JP); Hiroyuki Watanabe, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/785,721

(22) Filed: Feb. 10, 2020

(65) Prior Publication Data

US 2020/0264526 A1 Aug. 20, 2020

(30) Foreign Application Priority Data

Feb. 14, 2019 (JP) ..... JP2019-024713

(51) Int. Cl.

| | |
|---|---|
| ***G03G 5/047*** | (2006.01) |
| ***G03G 5/147*** | (2006.01) |
| ***G03G 5/06*** | (2006.01) |
| ***G03G 15/00*** | (2006.01) |
| ***G03G 21/18*** | (2006.01) |

(52) U.S. Cl.

CPC ..... *G03G 5/14734* (2013.01); *G03G 5/047* (2013.01); *G03G 5/0614* (2013.01); *G03G 5/0664* (2013.01); *G03G 5/0696* (2013.01); *G03G 15/75* (2013.01); *G03G 21/1814* (2013.01)

(58) Field of Classification Search

CPC ..... G03G 5/06142; G03G 5/06144; G03G 5/061443; G03G 5/071; G03G 5/072; G03G 5/0732

See application file for complete search history.

(56) References Cited

U.S. PATENT DOCUMENTS

| | | | |
|---|---|---|---|
| 6,991,881 | B2 | 1/2006 | Ogaki et al. |
| 6,994,941 | B2 | 2/2006 | Tanaka et al. |
| 7,001,699 | B2 | 2/2006 | Tanaka et al. |

(Continued)

FOREIGN PATENT DOCUMENTS

| | | |
|---|---|---|
| JP | 2002-040686 | 2/2002 |
| JP | 2006-010757 | 1/2006 |

(Continued)

*Primary Examiner* — Peter L Vajda

(74) *Attorney, Agent, or Firm* — Venable LLP

(57) ABSTRACT

The present disclosure provides an electrophotographic photosensitive member that suppresses electric potential fluctuations in repeated use. The electrophotographic photosensitive member includes a support, a photosensitive layer and a protective layer, in this order, wherein the photosensitive layer includes a compound having a structure represented by formula (1), and the protective layer includes a resin having a structure represented by formula (2) and a structure represented by formula (3).

8 Claims, 1 Drawing Sheet

(56) References Cited

U.S. PATENT DOCUMENTS

| | | | | |
|---|---|---|---|---|
| 7,045,261 | B2 | 5/2006 | Tanaka et al. | |
| 7,585,604 | B2 | 9/2009 | Ogaki et al. | |
| 7,629,103 | B2 | 12/2009 | Ikuno et al. | |
| 7,645,547 | B2 | 1/2010 | Okuda et al. | |
| 7,655,370 | B2 | 2/2010 | Kitamura et al. | |
| 7,875,411 | B2 * | 1/2011 | Aziz | G03G 5/0592 430/66 |
| 7,910,274 | B2 | 3/2011 | Tanaka et al. | |
| 7,927,774 | B2 | 4/2011 | Ogaki et al. | |
| 8,088,541 | B2 | 1/2012 | Tanaka et al. | |
| 8,455,170 | B2 | 6/2013 | Nakamura et al. | |
| 8,481,236 | B2 | 7/2013 | Tanaka et al. | |
| 8,632,935 | B2 | 1/2014 | Sugiyama et al. | |
| 8,669,027 | B2 | 3/2014 | Anezaki et al. | |
| 8,753,789 | B2 | 6/2014 | Ogaki et al. | |
| 8,765,335 | B2 | 7/2014 | Tanaka et al. | |
| 8,783,209 | B2 | 7/2014 | Kaku et al. | |
| 8,815,479 | B2 | 8/2014 | Shida et al. | |
| 8,846,281 | B2 | 9/2014 | Okuda et al. | |
| 8,865,381 | B2 | 10/2014 | Tanaka et al. | |
| 8,921,020 | B2 | 12/2014 | Murai et al. | |
| 8,980,508 | B2 | 3/2015 | Okuda et al. | |
| 8,980,509 | B2 | 3/2015 | Noguchi et al. | |
| 9,029,054 | B2 | 5/2015 | Okuda et al. | |
| 9,040,214 | B2 | 5/2015 | Fujii et al. | |
| 9,046,797 | B2 | 6/2015 | Fujii et al. | |
| 9,063,505 | B2 | 6/2015 | Sekiya et al. | |
| 9,069,267 | B2 | 6/2015 | Kaku et al. | |
| 9,114,565 | B2 | 8/2015 | Kawai et al. | |
| 9,170,506 | B2 | 10/2015 | Tanaka et al. | |
| 9,170,507 | B2 | 10/2015 | Sugiyama et al. | |
| 9,188,888 | B2 | 11/2015 | Okuda et al. | |
| 9,207,550 | B2 | 12/2015 | Okuda et al. | |
| 9,256,145 | B2 | 2/2016 | Fujii et al. | |
| 9,280,071 | B2 | 3/2016 | Maruyama et al. | |
| 9,280,072 | B2 | 3/2016 | Ogaki et al. | |
| 9,282,615 | B2 | 3/2016 | Yamagishi et al. | |
| 9,304,416 | B2 | 4/2016 | Noguchi et al. | |
| 9,341,964 | B2 | 5/2016 | Ogaki et al. | |
| 9,372,417 | B2 | 6/2016 | Fujii et al. | |
| 9,372,418 | B2 | 6/2016 | Shida et al. | |
| 9,372,419 | B2 | 6/2016 | Tsuji et al. | |
| 9,436,106 | B2 | 9/2016 | Kuno et al. | |
| 9,436,107 | B2 | 9/2016 | Murakami et al. | |
| 9,459,545 | B2 | 10/2016 | Tanaka et al. | |
| 9,523,929 | B2 | 12/2016 | Nakamura et al. | |
| 9,535,346 | B2 | 1/2017 | Sekiya et al. | |
| 9,541,850 | B2 | 1/2017 | Nishida et al. | |
| 9,563,139 | B2 | 2/2017 | Kawahara et al. | |
| 9,575,422 | B2 | 2/2017 | Okuda et al. | |
| 9,599,915 | B2 | 3/2017 | Anezaki et al. | |
| 9,599,917 | B2 | 3/2017 | Okuda et al. | |
| 9,645,515 | B2 | 5/2017 | Kuno et al. | |
| 9,645,516 | B2 | 5/2017 | Kawahara et al. | |
| 9,684,277 | B2 | 6/2017 | Yamamoto et al. | |
| 9,772,596 | B2 | 9/2017 | Mitsui et al. | |
| 9,791,792 | B2 | 10/2017 | Miyauchi et al. | |
| 9,869,032 | B2 | 1/2018 | Kawahara et al. | |
| 10,073,362 | B2 | 9/2018 | Fujii et al. | |
| 10,162,278 | B2 | 12/2018 | Kuno et al. | |
| 10,203,617 | B2 | 2/2019 | Kuno et al. | |
| 10,303,085 | B2 | 5/2019 | Sato et al. | |
| 10,372,050 | B2 | 8/2019 | Nishi et al. | |
| 10,416,581 | B2 | 9/2019 | Ito et al. | |
| 10,539,892 | B2 | 1/2020 | Nishida et al. | |
| 10,558,132 | B2 | 2/2020 | Ishiduka et al. | |
| 10,558,133 | B2 | 2/2020 | Nakamura et al. | |
| 2005/0208402 | A1 | 9/2005 | Tanaka et al. | |
| 2011/0229809 | A1 * | 9/2011 | Nukada | G03G 9/0825 430/56 |
| 2012/0301178 | A1 * | 11/2012 | Nonaka | G03G 5/14708 430/56 |
| 2014/0004450 | A1 | 1/2014 | Tokimitsu et al. | |
| 2014/0093281 | A1 | 4/2014 | Takahashi et al. | |
| 2015/0185630 | A1 | 7/2015 | Ito et al. | |
| 2015/0185634 | A1 | 7/2015 | Sekiya et al. | |
| 2015/0277246 | A1 | 10/2015 | Kaku et al. | |
| 2015/0277247 | A1 | 10/2015 | Sekiya et al. | |
| 2015/0316863 | A1 | 11/2015 | Tanaka et al. | |
| 2015/0346616 | A1 | 12/2015 | Kawahara et al. | |
| 2015/0346617 | A1 | 12/2015 | Kawahara et al. | |
| 2015/0362847 | A1 | 12/2015 | Tanaka et al. | |
| 2016/0091807 | A1 | 3/2016 | Tanaka et al. | |
| 2016/0131985 | A1 | 5/2016 | Tanaka et al. | |
| 2017/0060008 | A1 | 3/2017 | Okuda et al. | |
| 2019/0265601 | A1 | 8/2019 | Nishida et al. | |
| 2019/0265602 | A1 | 8/2019 | Nakamura et al. | |
| 2019/0369512 | A1 | 12/2019 | Okuda et al. | |
| 2019/0369514 | A1 | 12/2019 | Watanabe et al. | |
| 2019/0369517 | A1 | 12/2019 | Watanabe et al. | |
| 2019/0369529 | A1 | 12/2019 | Yagi et al. | |

FOREIGN PATENT DOCUMENTS

| | | |
|---|---|---|
| JP | 2008-209720 | 9/2008 |
| JP | 2012-113238 | 6/2012 |
| JP | 6429498 | 11/2018 |

* cited by examiner

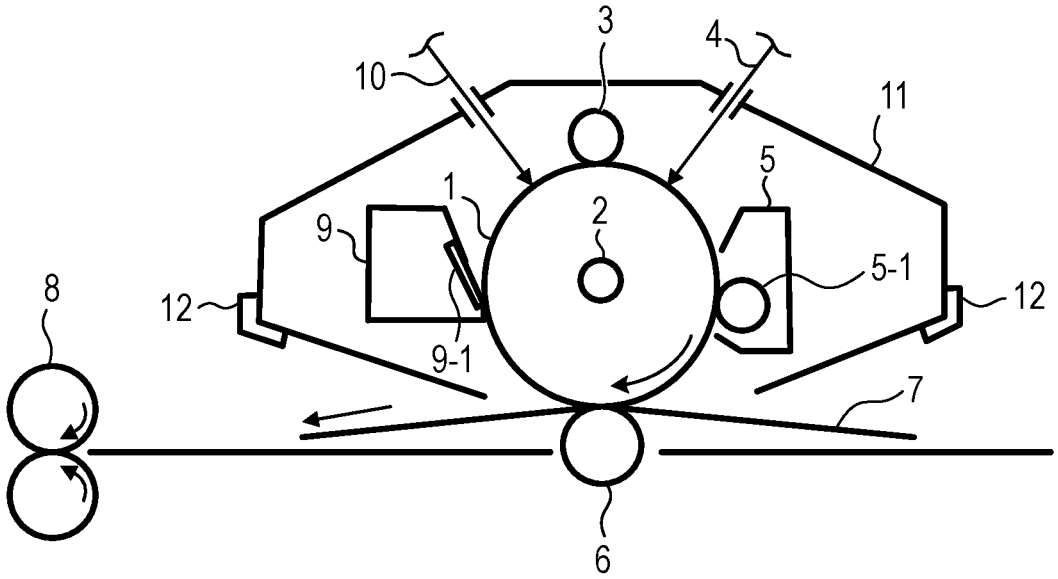
3
4
10
11
5
1
2
9
5-1
8
12
12
9-1
7
6

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present disclosure relates to an electrophotographic photosensitive member; and a process cartridge and an electrophotographic apparatus each having the electrophotographic photosensitive member.

Description of the Related Art

An electrophotographic photosensitive member containing an organic photoconductive substance (charge generation substance) is used as an electrophotographic photosensitive member that is mounted on a process cartridge and an electrophotographic image forming apparatus (hereinafter also referred to as "electrophotographic apparatus"). In recent years, an electrophotographic apparatus having a longer life has been required, and for this reason, it is desired to provide an electrophotographic photosensitive member that can improve image quality and abrasion resistance (mechanical durability) and suppress electric potential fluctuations.

Electrophotographic photosensitive members which are mounted on the electrophotographic apparatus have been extensively studied for improving the image quality and durability. As one example, there is a study for improving the abrasion resistance by providing a protective layer on the electrophotographic photosensitive member.

In Japanese Patent Application Laid-Open No. 2008-209720, a technology is described in which a photosensitive layer contains a benzidine arylamine compound and a protective layer contains a radical polymerizable compound. In addition, in Japanese Patent Application Laid-Open No. 2006-10757, such a technology is described as to cure a radical polymerizable compound by light energy irradiation in a low oxygen atmosphere, and form a protective layer.

According to the study by the present inventors, it has been found that in the electrophotographic photosensitive member described in Japanese Patent Application Laid-Open No. 2008-209720 and Japanese Patent Application Laid-Open No. 2006-10757, there is the case where electric potential fluctuations are large in repeated use. This reason is considered to be because charges are trapped in an interface between the protective layer and the photosensitive layer.

SUMMARY OF THE INVENTION

One aspect of the present disclosure is directed to providing an electrophotographic photosensitive member that suppresses the electric potential fluctuations in the repeated use.

In addition, another aspect of the present disclosure is directed to providing a process cartridge that contributes to the stable formation of high-quality electrophotographic images.

Furthermore, another aspect of the present disclosure is directed to providing an electrophotographic apparatus that can stably form the high-quality electrophotographic images.

According to one aspect of the present disclosure, there is provided an electrophotographic photosensitive member that has a support, a photosensitive layer and a protective layer, in this order, wherein the photosensitive layer contains a compound having a structure represented by formula (1); and the protective layer contains a resin having a structure represented by formula (2) and a structure represented by formula (3).

(1)

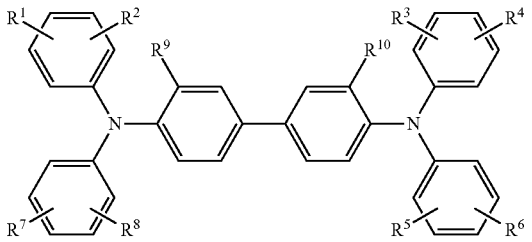

wherein $R^1$ to $R^{10}$ each independently represent a hydrogen atom or a methyl group.

(2)

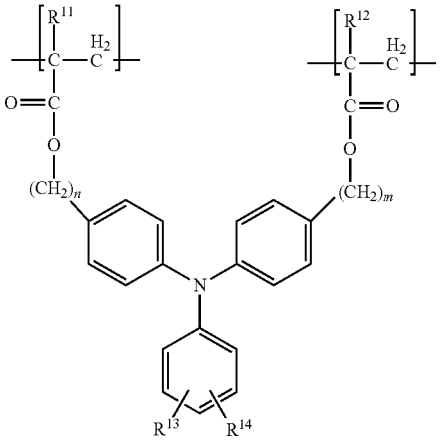

wherein $R^{11}$ to $R^{14}$ each independently represent a hydrogen atom, a methyl group or an ethyl group; and n is 2 to 5.

(3)

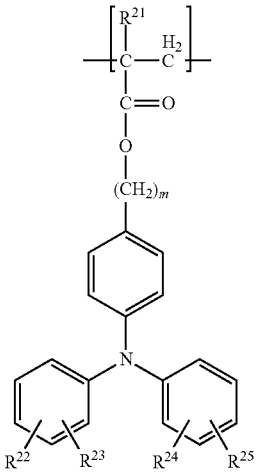

wherein $R^{21}$ to $R^{25}$ each independently represent a hydrogen atom, a methyl group or an ethyl group; and m is 2 to 5.

According to another aspect of the present disclosure, there is provided a process cartridge that is detachably attachable to a main body of the electrophotographic apparatus, the process cartridge including the above electrophotographic photosensitive member, and at least one selected from the group consisting of a charging member, a developing member and a cleaning member.

Furthermore, according to another aspect of the present disclosure, there is provided an electrophotographic apparatus that includes the above electrophotographic photosensitive member, a charging apparatus, an exposure apparatus and a developing apparatus.

Further features of the present disclosure will become apparent from the following description of exemplary embodiments with reference to the attached drawing.

BRIEF DESCRIPTION OF THE DRAWINGS

FIGURE illustrates a view illustrating one example of a schematic configuration of an electrophotographic apparatus that is provided with a process cartridge having an electrophotographic photosensitive member of the present disclosure.

DESCRIPTION OF THE EMBODIMENTS

Preferred embodiments of the present disclosure will now be described in detail in accordance with the accompanying drawing.

The present disclosure will be described below in detail with reference to preferred embodiments.

An electrophotographic photosensitive member (hereinafter also referred to as "photosensitive member") according to one embodiment of the present disclosure includes a support, a photosensitive layer, and a protective layer, in this order.

The photosensitive layer contains a compound having a structure represented by formula (1), and the protective layer contains a resin having a structure represented by formula (2) and a structure represented by formula (3).

Conventionally, as a technology for achieving both of abrasion resistance and suppression of afterimage after the repeated use for a long period of time, a method is known which makes a photosensitive layer contain a benzidine arylamine compound, and makes a protective layer contain a radical polymerizable compound which has a trifunctional or higher functional group and does not have a charge transporting structure.

However, as a result of investigations by the present inventors, it has been found that in this method, electric potential fluctuations deteriorate in repeated use in some cases. This reason is considered to be because electric charges have been trapped in the interface between the protective layer and the photosensitive layer because the density of a compound having a charge transporting structure has been insufficient there.

In order to solve the above problem, the present inventors have repeatedly studied the material types and material ratios of the photosensitive layer and the protective layer. As a result, the present inventors have found that an electrophotographic photosensitive member in which the photosensitive layer contains a compound that has a structure represented by formula (1) and the protective layer contains a resin having a structure represented by formula (2) and a structure represented by formula (3) can suppress the electric potential fluctuations in the repeated use.

(1)

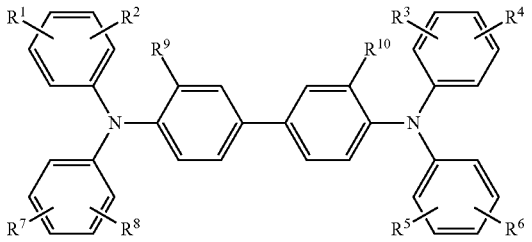

wherein $R^1$ to $R^{10}$ each independently represent a hydrogen atom or a methyl group.

(2)

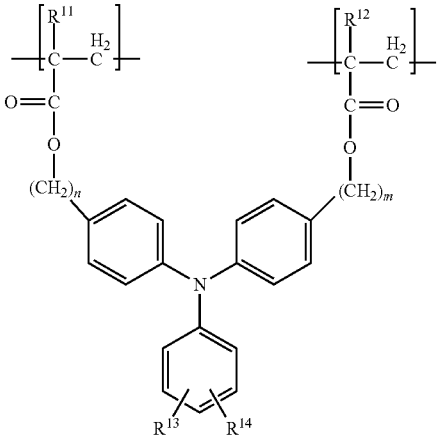

wherein $R^1$ to $R^{14}$ each independently represent a hydrogen atom, a methyl group or an ethyl group; and n is 2 to 5.

(3)

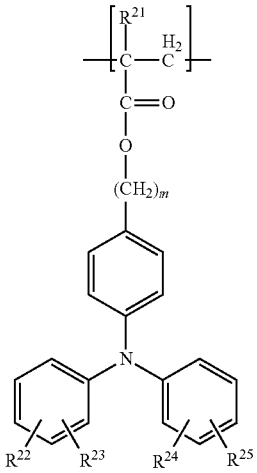

wherein $R^{21}$ to $R^{25}$ each independently represent a hydrogen atom, a methyl group or an ethyl group; and m is 2 to 5.

Preferred examples of the structure represented by the formula (1) are shown in formulae (1-1) to (1-10).

(1-1)
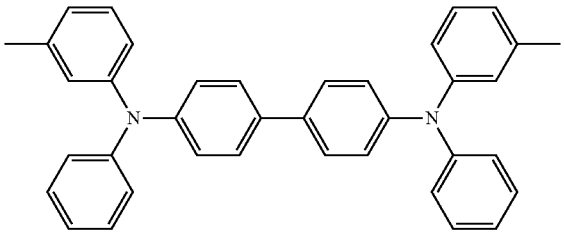
(1-2)
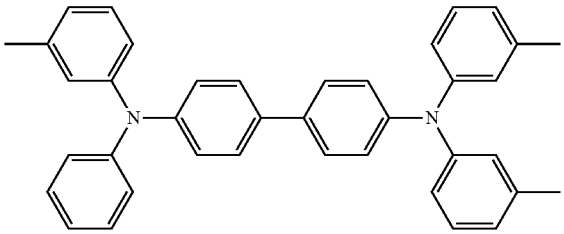
(1-3)
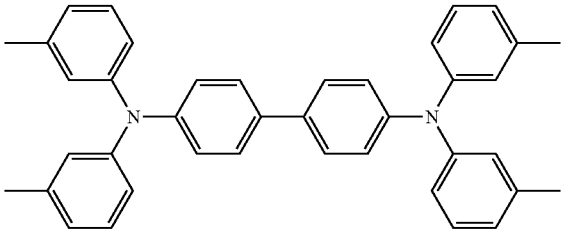
(1-4)
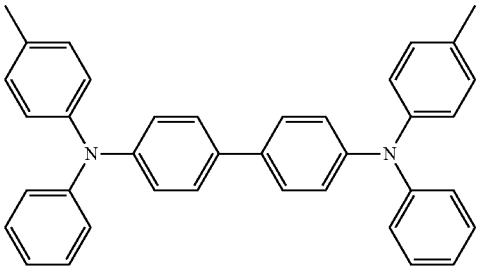
(1-5)
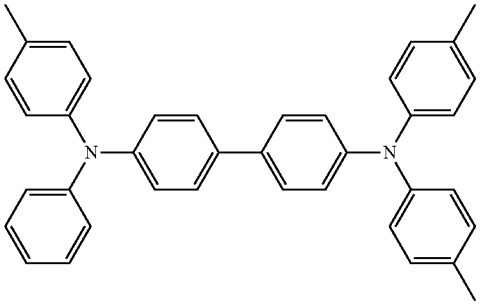
-continued
(1-6)
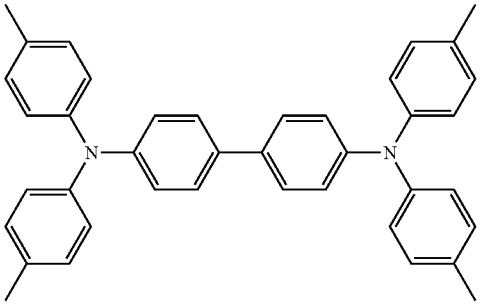
(1-7)
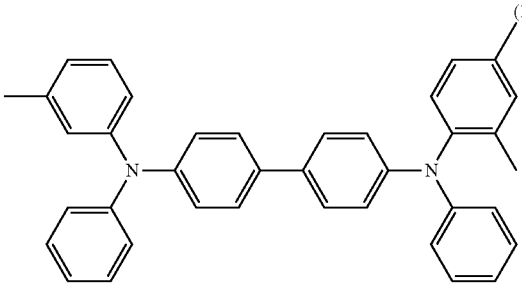
(1-8)
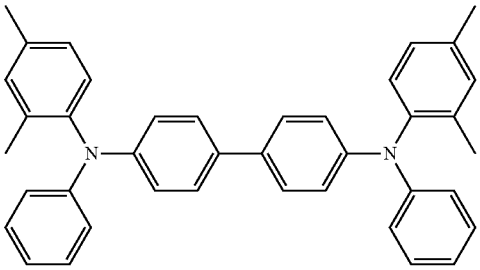
(1-9)
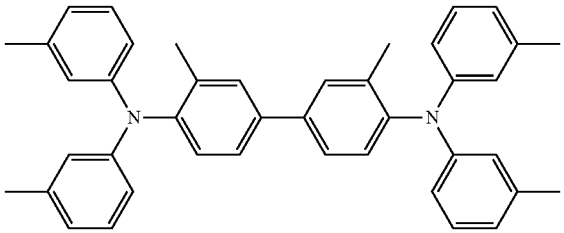
(1-10)
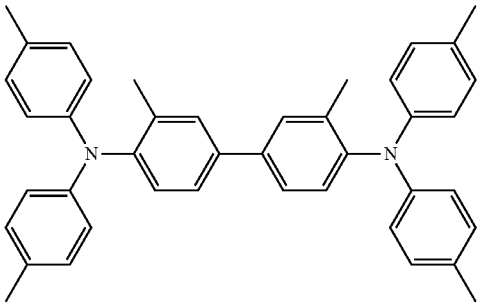
Among the formulae, the structures represented by the formulae (1-1) to (1-6) are more preferable.
Preferred examples of the structure represented by the formula (2) are shown in formulae (2-1) to (2-5).

(2-1)
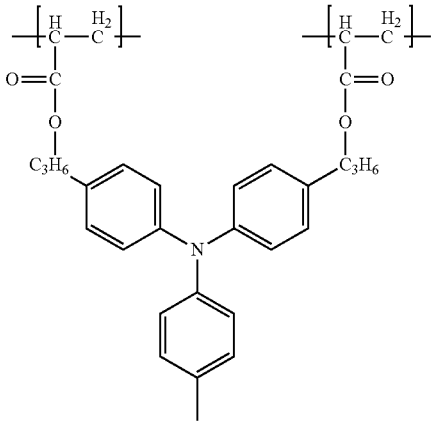
(2-2)
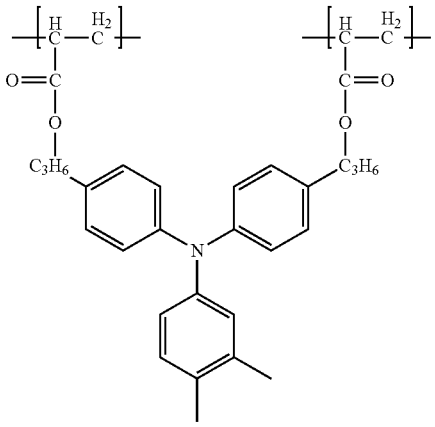
(2-3)
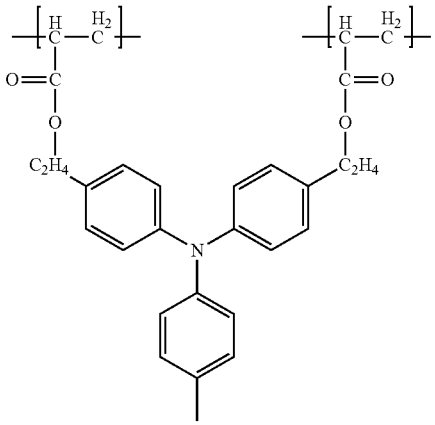
(2-4)
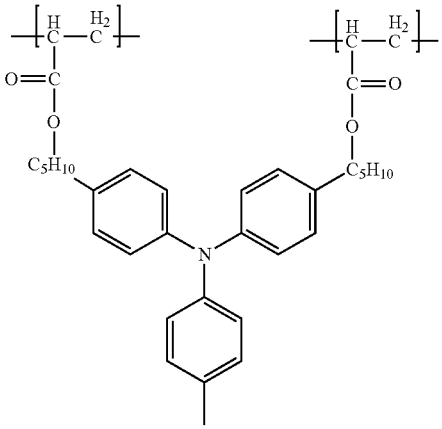
-continued
(2-5)
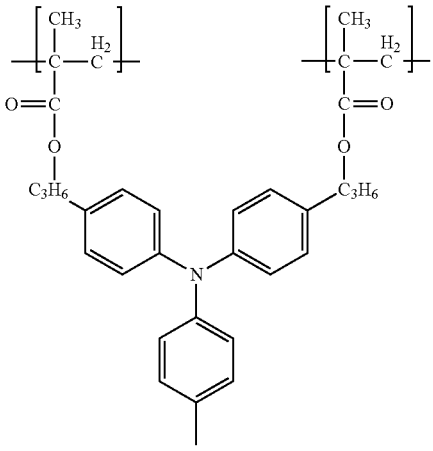
Among the formulae, the structures represented by the formulae (2-1) and (2-2) are more preferable.
Preferred examples of the structure represented by the formula (3) are shown in formulae (3-1) to (3-5).
(3-1)
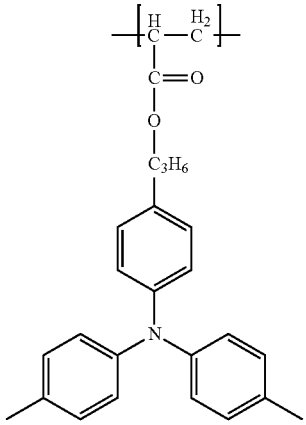
(3-2)
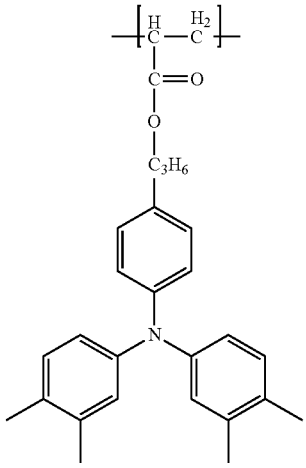

-continued (3-3)

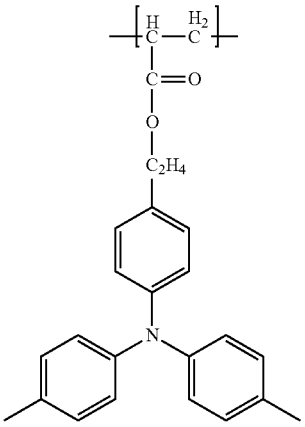

(3-4)

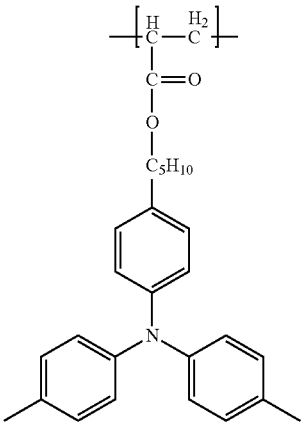

(3-5)

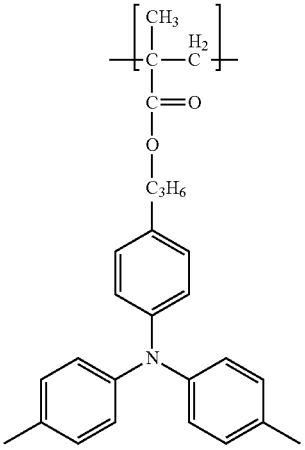

Among the formulae, the structures represented by the formulae (3-1) and (3-2) are more preferable.

Furthermore, it is more preferable that each of $R^{11}$ and $R^{12}$ in the above formula (2) and $R^{21}$ in the above formula (3) is a hydrogen atom.

The present inventors consider the following three mechanisms as mechanisms through which such a configuration can solve the above technical problems.

(1) The first one is a distance between the charge transporting substance of the protective layer and the charge transporting substance of the photosensitive layer, in the interface between the protective layer and the photosensitive layer (hereinafter also referred to as "interface"). In the present disclosure, both of the protective layer and the photosensitive layer have a configuration which has a triarylamine skeleton having charge transporting properties. It is considered that the triarylamine skeletons are stacked together which are contained in the protective layer and the photosensitive layer and exist in the vicinity of the interface, thereby the distance decreases between the charge transporting substance of the protective layer and the charge transporting substance of the photosensitive layer, in the interface, and as a result, the trapping of electric charges is suppressed.

(2) The second one is that the distance is short between the charge transporting substances in the protective layer, which exist in the vicinity of the interface. In the present disclosure, the photosensitive layer has a configuration containing a charge transporting substance having a benzidine arylamine skeleton. The benzidine arylamine skeleton has a structure in which two triarylamine skeletons are closest to each other in the molecule, and the distance decreases between the triarylamine skeleton of the protective layer and the triarylamine skeleton of the photosensitive layer which are stacked in the interface. Accordingly, it is considered that when the distance between the charge transporting substances of the protective layer, which exist in the vicinity of the interface decreases, and electric charges are transported in the interface between the photosensitive layer and the protective layer, a delivery of the electric charge is smoothly performed in the interface.

(3) The third one is an enhancement of the density of the charge transporting substance in the protective layer. In the present disclosure, the protective layer has a configuration which contains a radically polymerizable compound having a monofunctional group and a radically polymerizable compound having a bifunctional group, each having a charge transporting structure. As compared with the case where the protective layer contains a non-charge transporting substance having a trifunctional or higher functional group, in the prior art, in the configuration of the present disclosure, a main chain of the cross-linked film is formed by a charge transporting structure, when the protective layer is formed, and because of this, the density of the charge transporting substance in the protective layer can be improved. In addition, the radical polymerizable compound having a monofunctional group in the protective layer enters the gap between the main chains of the cross-linked film which is formed from a radically polymerizable compound having a bifunctional group, and thereby the density of the charge transporting substance in the protective layer is improved. As described above, the density of the charge transporting substance in the protective layer is improved, and thereby, the electric potential fluctuations are more remarkably suppressed in the repeated use, based on the above two mechanisms.

As described above, it is considered that the effects of the present disclosure can be obtained by each configuration of the protective layer and the photosensitive layer exerting a synergetic effect on each other.

In the present disclosure, it is preferable that a content of the compound represented by the formula (1) based on the total mass of the photosensitive layer is 30% by mass or more and 70% by mass or less. As long as the content is in the above range, the compound having a charge transporting structure can secure sufficient density in a photosensitive layer, and can suppress the electric potential fluctuations in the repeated use.

In the present disclosure, it is preferable that the total content of the content of the structure represented by the formula (2) and the content of the structure represented by the formula (3) is 60% by mass or more, based on the total mass of the protective layer. If the content is in the above range, the density in the interface of the compound which has the charge transporting structure in the protective layer can be sufficiently secured, and the electric potential fluctuations in the repeated use can be suppressed.

Furthermore, in the present disclosure, it is preferable that the content of the structure represented by the formula (3) based on the total content of the content of the structure represented by the formula (2) and the content of the structure represented by the formula (3) is 25% by mass or more and 80% by mass or less. If the content is in the above range, the density of the compound having a charge transporting structure in the protective layer can be sufficiently secured while fluctuations of the film thickness of the protective layer in the repeated use are suppressed, and accordingly the electric potential fluctuations in the repeated use can be suppressed.

[Electrophotographic Photosensitive Member]

An electrophotographic photosensitive member according to one embodiment of the present disclosure includes a support, a photosensitive layer and a protective layer.

A method for producing the electrophotographic photosensitive member according to one embodiment of the present disclosure includes a method of: preparing coating liquids for each layer which will be described later; applying the coating liquids in order of desired layers, respectively; and drying the coating liquids. The method for applying the coating liquid at this time includes dip coating, spray coating, inkjet coating, roll coating, die coating, blade coating, curtain coating, wire bar coating and ring coating. Among the methods, the dip coating is preferable from the viewpoints of efficiency and productivity.

The support and each layer will be described below.

<Support>

In the present disclosure, the electrophotographic photosensitive member has a support. In the present disclosure, it is preferable that the support is an electroconductive support having electroconductivity. In addition, shapes of the support include a cylindrical shape, a belt shape and a sheet shape. Among the shapes, the cylindrical support is preferable. In addition, the surface of the support may be subjected to: electrochemical treatment such as anodic oxidation; blast treatment; cutting treatment; and the like.

The material of the support is preferably metal, resin, glass or the like.

The metals include aluminum, iron, nickel, copper, gold, stainless steel, and alloys thereof. Among the metals, an aluminum support using aluminum is preferable.

In addition, electroconductivity may be imparted to the resin or glass, by a treatment such as mixing of an electroconductive material into the resin or glass or covering of the resin or glass with the electroconductive material.

<Electroconductive Layer>

An electroconductive layer may be provided on the support. The electroconductive layer, by being provided, can conceal a scratch and unevenness on a support surface and control reflection of light on the support surface.

It is preferable that the electroconductive layer contains an electroconductive particle and a resin.

Materials of the electroconductive particle include metal oxide, metal, and carbon black. The metal oxides include zinc oxide, aluminum oxide, indium oxide, silicon oxide, zirconium oxide, tin oxide, titanium oxide, magnesium oxide, antimony oxide and bismuth oxide. The metals include aluminum, nickel, iron, nichrome, copper, zinc and silver.

Among the materials, it is preferable to use the metal oxide as the electroconductive particle, and in particular, it is more preferable to use titanium oxide, tin oxide or zinc oxide.

When the metal oxide is used as the electroconductive particle, the surface of the metal oxide can be treated with a silane coupling agent or the like, or the metal oxide can be doped with an element such as phosphorus or aluminum or with an oxide thereof.

In addition, the electroconductive particle may have a layered configuration having a core particle and a covering layer which covers the particle. The core particles include titanium oxide, barium sulfate and zinc oxide. The covering layer includes a metal oxide such as tin oxide.

In addition, when the metal oxide is used as the electroconductive particle, it is preferable for the volume average particle size thereof to be 1 nm or larger and 500 nm or smaller, and it is more preferable to be 3 nm or larger and 400 nm or smaller.

The resins include a polyester resin, a polycarbonate resin, a polyvinyl acetal resin, an acrylic resin, a silicone resin, an epoxy resin, a melamine resin, a polyurethane resin, a phenolic resin and an alkyd resin.

In addition, the electroconductive layer may further contain a concealing agent such as silicone oil, a resin particle, and titanium oxide.

The average film thickness of the electroconductive layer is preferably 1 μm or larger and 50 μm or smaller, and is particularly preferably 3 μm or larger and 40 μm or smaller.

The electroconductive layer can be formed by preparing a coating liquid for an electroconductive layer, which contains each of the above materials and a solvent, forming a coating film of the coating liquid on the support, and drying the coating film. The solvents to be used in the coating liquid include an alcohol-based solvent, a sulfoxide-based solvent, a ketone-based solvent, an ether-based solvent, an ester-based solvent, and an aromatic hydrocarbon-based solvent. A dispersing method for dispersing the electroconductive particles in the coating liquid for the electroconductive layer includes a method which uses a paint shaker, a sand mill, a ball mill or a liquid collision type high speed disperser.

<Undercoat Layer>

An undercoat layer may be provided on the support or the electroconductive layer. The undercoat layer, by being provided, can enhance an adhesion function between the layers, and impart a charge injection inhibition function.

It is preferable that the undercoat layer contains a resin. In addition, the undercoat layer may be formed as a cured film by polymerization of a composition which contains a monomer having a polymerizable functional group.

The resins include a polyester resin, a polycarbonate resin, a polyvinyl acetal resin, an acrylic resin, an epoxy resin, a melamine resin, a polyurethane resin, a phenolic resin, a polyvinyl phenolic resin, an alkyd resin, a polyvinyl alcohol resin, a polyethylene oxide resin, a polypropylene oxide resin, a polyamide resin, a polyamide acid resin, a polyimide resin, a polyamide-imide resin, and a cellulose resin.

The polymerizable functional group which the monomer having the polymerizable functional group has includes an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group and a carbon-carbon double bond group.

In addition, the undercoat layer may further contain an electron transport substance, a metal oxide, a metal, an electroconductive polymer and the like, for the purpose of enhancing electric characteristics. Among the substances, it is preferable to use the electron transport substance and the metal oxide.

The electron transport substances include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound and a boron-containing compound. It is also acceptable to form the undercoat layer as a cured film, by using an electron transport substance having a polymerizable functional group, as the electron transport substance, and copolymerizing the electron transport substance with the above monomer having the polymerizable functional group.

The metal oxides include indium tin oxide, tin oxide, indium oxide, titanium oxide, zinc oxide, aluminum oxide and silicon dioxide. The metals include gold, silver and aluminum.

In addition, the undercoat layer may further contain an additive.

An average film thickness of the undercoat layer is preferably 0.1 m or larger and 50 μm or smaller, is more preferably 0.2 μm or larger and 40 μm or smaller, and is particularly preferably 0.3 μm or larger and 30 μm or smaller.

The undercoat layer can be formed by preparing a coating liquid for the undercoat layer, which contains each of the above materials and a solvent, forming a coating film of the coating liquid on the support or the electroconductive layer, and drying and/or curing the coating film. The solvents to be used in the coating liquid include an alcohol-based solvent, a ketone-based solvent, an ether-based solvent, an ester-based solvent, and an aromatic hydrocarbon-based solvent.

<Photosensitive Layer>

The photosensitive layer of the electrophotographic photosensitive member is mainly classified into (1) a multilayer type photosensitive layer, and (2) a monolayer type photosensitive layer. The multilayer type photosensitive layer (1) includes a charge generation layer containing a charge generation substance and a charge transport layer containing a charge transporting substance. (2) The monolayer type photosensitive layer is a photosensitive layer that contains both of a charge generation substance and a charge transporting substance.

(1) Multilayer Type Photosensitive Layer

The multilayer type photosensitive layer includes a charge generation layer and a charge transport layer.

(1-1) Charge Generation Layer

It is preferable that the charge generation layer contains a charge generation substance and a resin.

The charge generation substances include an azo pigment, a perylene pigment, a polycyclic quinone pigment, an indigo pigment, and a phthalocyanine pigment. Among the pigments, the azo pigment and the phthalocyanine pigment are preferable. Among the phthalocyanine pigments, oxytitanium phthalocyanine pigment, chlorogallium phthalocyanine pigment and hydroxygallium phthalocyanine pigment are preferable.

The content of the charge generation substance in the charge generation layer is preferably 40% by mass or more and 85% by mass or less, and is more preferably 60% by mass or more and 80% by mass or less, based on the total mass of the charge generation layer.

The resins include a polyester resin, a polycarbonate resin, a polyvinyl acetal resin, a polyvinyl butyral resin, an acrylic resin, a silicone resin, an epoxy resin, a melamine resin, a polyurethane resin, a phenolic resin, a polyvinyl alcohol resin, a cellulose resin, a polystyrene resin, a polyvinyl acetate resin and a polyvinyl chloride resin. Among the resins, the polyvinyl butyral resin is more preferable.

In addition, the charge generation layer may further contain additives such as an antioxidizing agent and an ultraviolet absorbing agent. Specific additives include a hindered phenol compound, a hindered amine compound, a sulfur compound, a phosphorus compound and a benzophenone compound.

An average film thickness of the charge generation layer is preferably 0.1 μm or larger and 1 μm or smaller, and is more preferably 0.15 μm or larger and 0.4 μm or smaller.

The charge generation layer can be formed by preparing a coating liquid for the charge generation layer containing each of the above materials and a solvent, forming a coating film of the coating liquid on the undercoat layer, and drying the coating film. The solvents to be used in the coating liquid include an alcohol-based solvent, a sulfoxide-based solvent, a ketone-based solvent, an ether-based solvent, an ester-based solvent, and an aromatic hydrocarbon-based solvent.

(1-2) Charge Transport Layer

As has been described above, the charge transport layer contains the charge transporting substance represented by the formula (1).

The content of the charge transporting substance represented by the formula (1) in the charge transport layer is preferably 30% by mass or more and 70% by mass or less, and is more preferably 40% by mass or more and 55% by mass or less, based on the total mass of the charge transport layer.

The charge transport layer may contain another charge transporting substance than that represented by the formula (1). The charge transport substances include a polycyclic aromatic compound, a heterocyclic compound, a hydrazone compound, a styryl compound, an enamine compound, a benzidine compound, a triarylamine compound, and resins having groups derived from these substances. Among the substances, the triarylamine compound and the benzidine compound are preferable. The content of the charge transporting substance represented by the formula (1) is preferably 50% by mass or more, and is more preferably 80% by mass or more, based on the total weight of the charge transporting substances in the charge transport layer.

It is preferable that the charge transport layer contains a resin.

The resins include a polyester resin, a polycarbonate resin, an acrylic resin and a polystyrene resin. Among the resins, the polycarbonate resin and the polyester resin are preferable. In the polyester resins, a polyarylate resin is particularly preferable.

A content ratio (mass ratio) of the charge transporting substance to the resin is preferably 4:10 to 20:10, and is more preferably 7:10 to 12:10.

In addition, the charge transport layer may contain additives such as an antioxidizing agent, an ultraviolet absorbing agent, a plasticizing agent, a leveling agent, a slipperiness imparting agent, and an abrasion resistance improver. The specific additives include a hindered phenol compound, a hindered amine compound, a sulfur compound, a phosphorus compound, a benzophenone compound, a siloxane modified resin, silicone oil, a fluorocarbon resin particle, a polystyrene resin particle, a polyethylene resin particle, a silica particle, an alumina particle and a boron nitride particle.

An average film thickness of the charge transport layer is preferably 5 μm or larger and 50 μm or smaller, is more preferably 8 μm or larger and 40 μm or smaller, and is particularly preferably 10 μm or larger and 30 μm or smaller.

The charge transport layer can be formed by preparing a coating liquid for the charge transport layer, which contains each of the above materials and a solvent, forming a coating film of the coating liquid on the charge generation layer, and drying the coating film. The solvents to be used in the coating liquid include an alcohol-based solvent, a ketone-based solvent, an ether-based solvent, an ester-based solvent, and an aromatic hydrocarbon-based solvent. Among the above solvents, the ether-based solvent or the aromatic hydrocarbon-based solvent is preferable.

(2) Monolayer Type Photosensitive Layer

The monolayer type photosensitive layer can be formed by preparing a coating liquid for the photosensitive layer, which contains the charge generation substance, the charge transporting substance, a resin and a solvent, forming a coating film of the coating liquid on the support or the undercoat layer, and drying the coating film. The charge generation substance, the charge transporting substance, and the resin are similar to the exemplifications of the materials in the above "(1) Multilayer type photosensitive layer".

An average film thickness of the monolayer type photosensitive layer is preferably 5 μm or larger and 50 μm or smaller, is more preferably 8 μm or larger and 40 μm or smaller, and is particularly preferably 10 μm or larger and 30 μm or smaller.

<Protective Layer>

The protective layer to be formed on the photosensitive layer includes a resin having a structure represented by the formula (2) and a structure represented by the formula (3).

Such a protective layer can be configured to be formed of a cured film, for example, by the polymerization of a composition which contains a compound corresponding to the structure represented by the formula (2) and the structure represented by the formula (3).

Reactions at this time include a thermal polymerization reaction, a photopolymerization reaction, and a radiation polymerization reaction. Polymerizable functional groups which the compound has include an acryloyl group and a methacryloyl group.

The compounds corresponding to the structure represented by the formula (2) and the structure represented by the formula (3) include a compound represented by formula (4) and a compound represented by formula (5), respectively.

In other words, the protective layer of the electrophotographic photosensitive member according to one embodiment of the present disclosure contains a polymerized product of a composition containing a compound represented by the formula (4) and a compound represented by the formula (5).

(4)

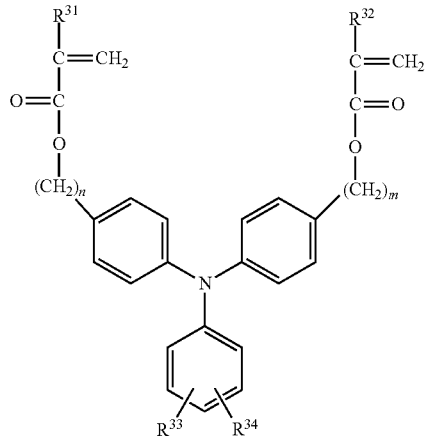

wherein $R^{31}$ to $R^{34}$ each independently represent a hydrogen atom, a methyl group or an ethyl group; and n is 2 to 5.

In addition, in the formula (4), $R^{33}$ and $R^{34}$ are each preferably a hydrogen atom or a methyl group, and $R^{31}$ and $R^{32}$ are each preferably a hydrogen atom.

(5)

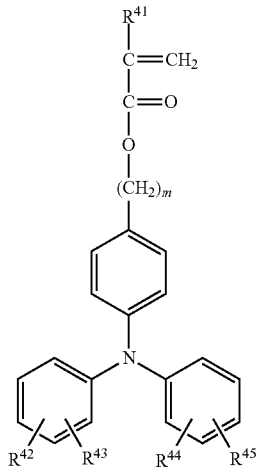

wherein $R^{41}$ to $R^{45}$ each independently represent a hydrogen atom, a methyl group or an ethyl group; and m is 2 to 5.

In addition, in the formula (5), $R^{42}$ to $R^{45}$ are each preferably a hydrogen atom or a methyl group, and $R^{41}$ is preferably a hydrogen atom.

The protective layer may contain additives such as an antioxidizing agent, an ultraviolet absorbing agent, a plasticizing agent, a leveling agent, a slipperiness imparting agent, and an abrasion resistance improver. The specific additives include a hindered phenol compound, a hindered amine compound, a sulfur compound, a phosphorus compound, a benzophenone compound, a siloxane modified resin, silicone oil, a fluorocarbon resin particle, a polystyrene resin particle, a polyethylene resin particle, a silica particle, an alumina particle and a boron nitride particle.

The protective layer may contain an electroconductive particle and/or a charge transporting substance, and a resin.

The electroconductive particles include particles of metal oxides such as titanium oxide, zinc oxide, tin oxide and indium oxide.

The charge transporting substances include a polycyclic aromatic compound, a heterocyclic compound, a hydrazone compound, a styryl compound, an enamine compound, a benzidine compound, a triarylamine compound, and resins having groups derived from these substances. Among the substances, the triarylamine compound and the benzidine compound are preferable.

The resins include a polyester resin, an acrylic resin, a phenoxy resin, a polycarbonate resin, a polystyrene resin, a phenolic resin, a melamine resin and an epoxy resin. Among the resins, the polycarbonate resin, the polyester resin and the acrylic resin are preferable.

An average film thickness of the protective layer is preferably 0.5 μm or larger and 10 μm or smaller, and is more preferably 1 μm or larger and 7 μm or smaller.

The protective layer can be formed by preparing a coating liquid for the protective layer, which contains each of the above materials and a solvent, forming a coating film of the coating liquid on the photosensitive layer, and drying and/or curing the coating film. The solvents to be used for the coating liquid include an alcohol-based solvent, a ketone-based solvent, an ether-based solvent, a sulfoxide-based solvent, an ester-based solvent and an aromatic hydrocarbon-based solvent.

[Process Cartridge, and Electrophotographic Image Forming Apparatus]

The process cartridge according to one embodiment of the present disclosure is detachably attachable to a main body of the electrophotographic apparatus. In addition, the process cartridge includes an electrophotographic photosensitive member according to the present disclosure, and at least one selected from the group consisting of a charging member, a developing member and a cleaning member.

In addition, an electrophotographic apparatus according to one embodiment of the present disclosure includes the electrophotographic photosensitive member according to the present disclosure, and at least one selected from the group consisting of a charging apparatus, an exposure apparatus, a developing apparatus and a transfer apparatus.

FIGURE illustrates one example of a schematic configuration of an electrophotographic apparatus having a process cartridge 11 that includes an electrophotographic photosensitive member 1 according to the present disclosure, a charging roller 3 which functions as a charging member, a developing roller 5-1 which functions as a developing member, and a cleaning blade 9-1 which functions as a cleaning member.

A cylinder-shaped electrophotographic photosensitive member 1 is rotationally driven around a shaft 2 in the direction of the arrow at a predetermined peripheral velocity. The surface of the electrophotographic photosensitive member 1 is charged at a predetermined positive or negative potential by a charging unit 3. For information, FIGURE illustrates a charging apparatus which has a charging roller as a charging member, but a charging apparatus may be used which performs electric charging such as corona charging, proximity charging, and injection charging.

The surface of the electrically charged electrophotographic photosensitive member 1 is irradiated with exposure light 4 emitted from an exposure apparatus (not illustrated), and an electrostatic latent image is formed which corresponds to desired image information.

The electrostatic latent image formed on the surface of the electrophotographic photosensitive member 1 is developed by a toner stored in a developing apparatus 5, and a toner image is formed on the surface of the electrophotographic photosensitive member 1. The developing apparatus 5 has the developing roller 5-1 as the developing member.

The toner image formed on the surface of the electrophotographic photosensitive member 1 is transferred to a transfer material 7 such as paper by a transfer apparatus (transfer roller) 6.

The transfer material 7 onto which the toner image has been transferred is conveyed to a fixing apparatus 8, is subjected to fixing treatment of the toner image, and is printed out to the outside of the electrophotographic apparatus.

The electrophotographic apparatus may have a cleaning apparatus 9 for removing adherents such as a toner remaining on the surface of the electrophotographic photosensitive member 1 after transferring. It is preferable that the cleaning apparatus has a cleaning blade 9-1 which is made from, for example, a urethane resin. In addition, it is also acceptable to use a so-called cleaner-less system which removes the above adherents by a developing unit or the like, instead of providing the cleaning apparatus 9.

The electrophotographic apparatus may have a neutralization mechanism that subjects the surface of the electrophotographic photosensitive member 1 to neutralization treatment by pre-exposure light 10 emitted from a pre-exposure unit (not illustrated). In addition, a guiding unit 12 such as a rail may also be provided so that the process cartridge 11 according to one embodiment of the present disclosure is attached to or detached from a main body of the electrophotographic image forming apparatus.

The electrophotographic photosensitive member according to the present disclosure can be used in an electrophotographic image forming apparatus such as a laser beam printer, an LED printer, a copying machine, a facsimile, and a composite machine thereof.

According to the present disclosure, there can be provided an electrophotographic photosensitive member that suppresses the electric potential fluctuations in the repeated use. In addition, according to another aspect of the present disclosure, there can be provided a process cartridge and an electrophotographic image forming apparatus each of which has the above electrophotographic photosensitive member that suppresses the electric potential fluctuations in the repeated use.

Example

The present disclosure will be described below in more detail with reference to Examples and Comparative Examples. The present disclosure is not limited to the following Examples at all, as long as the present disclosure does not depart from the gist thereof. Not that in the description of the following Examples, "part" is based on mass unless otherwise specified.

<Manufacture of Electrophotographic Photosensitive Member>

Example 1

An aluminum cylinder (JIS-A3003, aluminum alloy) of which the diameter is 24 mm and the length is 257 mm was used as a support (electroconductive support).

Next, the following materials were prepared.

214 parts of a titanium oxide ($TiO_2$) particle (average primary particle size of 230 nm) which is coated with oxygen-deficient type tin oxide ($SnO_2$) functioning as a metal oxide particle 132 parts of a phenolic resin (monomer/oligomer of phenolic resin) as a binding material (trade name: Plyophen J-325, produced by DIC Corporation, and resin solid content: 60% by mass)

98 parts of 1-methoxy-2-propanol which functions as the solvent

These materials were charged into a sand mill which uses 450 parts of glass beads with a diameter of 0.8 mm; and were subjected to a dispersion treatment under the conditions of a rotational speed of 2,000 rpm, a dispersion treatment time period of 4.5 hours, and a set temperature of cooling water of 18° C.; and a dispersion liquid was obtained. The glass beads were removed from this dispersion liquid, by a mesh (aperture: 150 μm). A silicone resin particle (trade name: Tospearl 120, produced by Momentive Performance Materials Inc., and average particle size of 2 μm) which functioned as a surface roughness imparting agent were added to the obtained dispersion liquid. The amount of the silicone resin particles to be added was set so as to become 10% by mass based on the total mass of the metal oxide particle and the binder material in the dispersion liquid after the glass beads have been removed.

In addition, silicone oil (trade name: SH28PA, produced by Dow Corning Toray Co., Ltd.) which functioned as a leveling agent was added to the dispersion liquid so as to become 0.01% by mass based on the total mass of the metal oxide particle and the binder material in the dispersion liquid.

Next, a mixed solvent of methanol and 1-methoxy-2-propanol (mass ratio 1:1) was added to the dispersion liquid so that the total mass (in other words, mass of solid content) of the metal oxide particle, the binder material and the surface roughness imparting agent in the dispersion liquid became 67% by mass based on the mass of the dispersion liquid.

After that, the resultant dispersion liquid was stirred, and thereby a coating liquid for an electroconductive layer was prepared. The support was dip-coated with this coating liquid for the electroconductive layer, the coating film was heated at 140° C. for 1 hour, and an electroconductive layer having a film thickness of 30 μm was formed.

Next, the following materials were prepared.

3.11 parts of electron transport substance represented by the following formula (E-1)

6.49 parts of block isocyanate (trade name: SBB-70P, produced by Asahi Kasei Corp.)

0.40 parts of styrene-acrylic resin (trade name: UC-3920, produced by Toagosei Co., Ltd.)

0.05 parts of zinc hexanoate (II) which functions as a catalyst (produced by Mitsuwa Chemicals Co., Ltd.)

These materials were dissolved in a mixed solvent of 48 parts of 1-butanol and 24 parts of acetone. To this solution, 1.8 parts of silica slurry (product name: IPA-ST-UP, produced by Nissan Chemical Industries, Ltd., concentration of solid content: 15% by mass, and viscosity: 9 mPa·s) which was dispersed in isopropyl alcohol was added, and the mixture was stirred for 1 hour. After that, the liquid was pressure filtered with the use of a filter (trade name: PF020, produced by Advantec Co., Ltd.) which was made from polytetrafluoroethylene (PTFE). The electroconductive layer was dip-coated with the obtained coating liquid for the undercoat layer, and the coating film was heated at 170° C. for 40 minutes, and thereby an undercoat layer having a film thickness of 0.7 μm was formed.

(E-1)

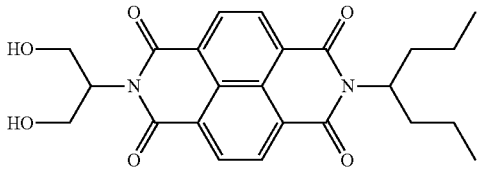

Next, a crystalline form of hydroxygallium phthalocyanine in an amount of 10 parts, which had peaks at positions of 7.5° and 28.4° in a chart obtained from CuKα characteristic X-ray diffraction, and a polyvinyl butyral resin (trade name: ESREC BX-1; produced by Sekisui Chemical Co., Ltd.) in an amount of 5 parts were prepared. These materials were added to 200 parts of cyclohexanone, and the solid was dispersed for 6 hours in a sand mill apparatus which used glass beads having a diameter of 0.9 mm. To the dispersion liquid, 150 parts of cyclohexanone and 350 parts of ethyl acetate were further added to dilute the dispersion liquid, and a coating liquid for a charge generation layer was obtained. The undercoat layer was dip-coated with the obtained coating liquid, the coating film was dried at 95° C. for 10 minutes, and thereby the charge generation layer having a film thickness of 0.20 μm was formed.

Note that the measurement with the X-ray diffraction was performed under the following conditions.

[Powder X-Ray Diffraction Measurement]

Used measurement instrument: X-ray diffractometer RINT-TTRII, manufactured by Rigaku Corporation X-ray tube bulb: Cu
Tube voltage: 50 KV
Tube current: 300 mA
Scanning method: 2θ/θ scan
Scanning speed: 4.0°/min
Sampling interval: 0.02°
Start angle (2θ): 5.0°
Stop angle (2θ): 40.0°
Attachment: standard specimen holder
Filter: nonuse
Incident monochrome: used
Counter monochromator: nonuse
Divergent slit: open
Divergence length restriction slit: 10.00 mm
Scattering slit: open
Light receiving slit: open
Flat plate monochromator: used
Counter: scintillation counter Next, the following materials were prepared.

5 parts of a charge transporting substance represented by the formula (1-1)

5 parts of a charge transporting substance represented by formula (1-3)

10 parts of polycarbonate (trade name: Iupilon Z400, produced by Mitsubishi Engineering-Plastics Corporation)

0.02 parts of a polycarbonate resin having a copolymer unit of formula (C-4) and formula (C-5) (x:y=0.95:0.05, and viscosity average molecular weight=40000)

These materials were dissolved in a mixed solvent of 25 parts of orthoxylene/25 parts of methyl benzoate/25 parts of dimethoxymethane, and thereby a coating liquid for the charge transport layer was prepared. The charge generation layer was dip-coated with this coating liquid for the charge transport layer to have a coating film formed thereon, and the resultant coating film was dried at 120° C. for 30 minutes to form a charge transport layer having a film thickness of 16 μm.

(C-4)

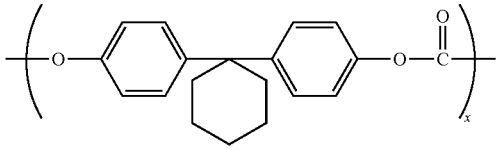

(C-5)

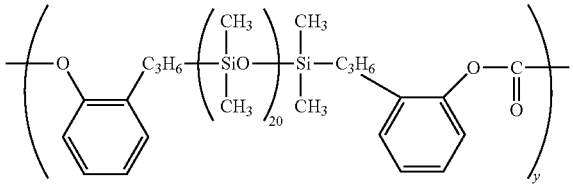

Next, the following materials were prepared.

9.6 parts of a compound represented by formula (4-1)

14.4 parts of a compound represented by formula (5-1)

0.1 parts of a siloxane-modified acrylic compound (SYMAC US270, manufactured by Toagosei Co., Ltd.)

(4-1)

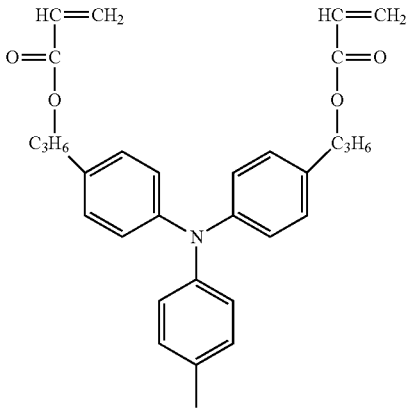

(5-1)

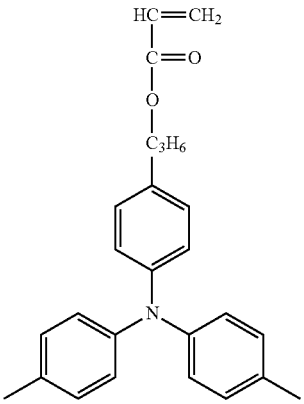

These materials were mixed with a mixed solvent of 42 parts of cyclohexane and 18 parts of 1-propanol, and the resultant mixture was stirred. In this way, the coating liquid for a protective layer was prepared.

The charge transport layer was dip-coated with this coating liquid for the protective layer to have a coating film formed thereon, and the obtained coating film was dried at 35° C. for 4 minutes. After that, in a nitrogen atmosphere, under the conditions of an acceleration voltage of 57 kV and a beam current of 5.3 mA, the distance between the support (body to be irradiated) and the electron beam irradiation window was set at 25 mm, and the coating film was irradiated with an electron beam for 4.8 seconds, while the support (body to be irradiated) was rotated at a speed of 300 rpm. For information, the absorbed dose of the electron beam at this time was measured, and as a result, was 20 kGy. After that, in a nitrogen atmosphere, the temperature was raised from 25° C. to 137° C. over 10 seconds, and the coating film was heated. A concentration of oxygen after the electron beam irradiation and before the subsequent heat treatment was 10 ppm or less. Next, in the air, the coating film was naturally cooled until the temperature of the coating film reached 25° C., and was subjected to heat treatment for 10 minutes under the condition that the temperature of the coating film became 100° C., and the protective layer having a film thickness of 3 μm was formed. In this way, a cylinder-shaped (drum-shaped) electrophotographic photosensitive member having the protective layer of Example 1 was produced.

Examples 2 to 21

An electrophotographic photosensitive member was produced in the same manner as in Example 1, except that the following factors were changed as shown in Table 1: a type and mixing ratio of the charge transporting substance to be mixed in the coating liquid for the charge transport layer; a content of the charge transporting substance based on the total mass of the charge transport layer; types and mixing ratios of the compounds represented by the formula (4) and the formula (5) to be mixed in the coating liquid for the protective layer; and a total content of the compounds represented by the formula (4) and the formula (5) based on the total mass of the protective layer. The compounds represented by formulas (4-2) to (4-5), (5-2) to (5-5), (6) and (7) in Table 1 will be shown below.

(4-2)

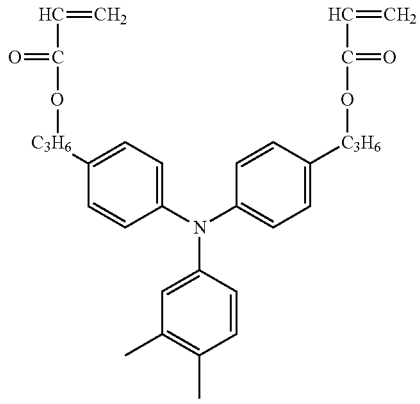

-continued
(4-3)
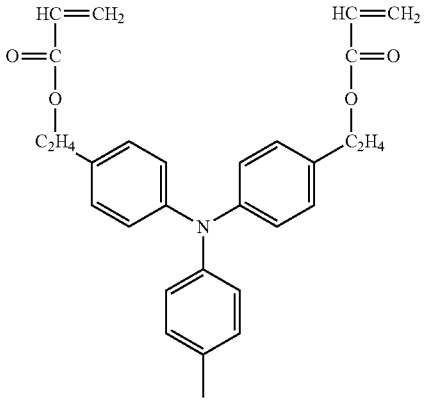
(4-4)
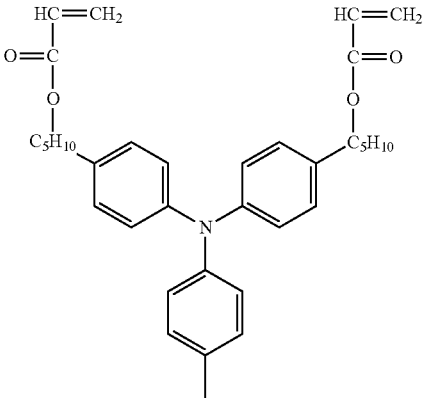
(4-5)
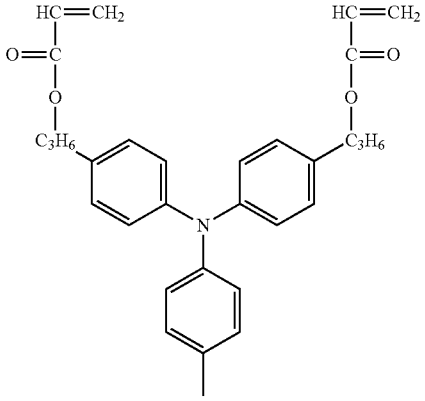
(5-2)
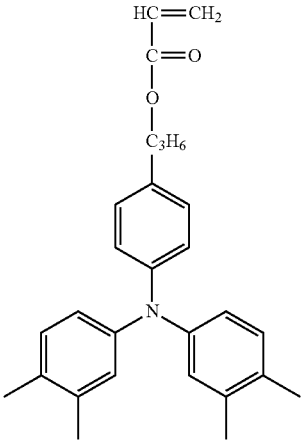
-continued
(5-3)
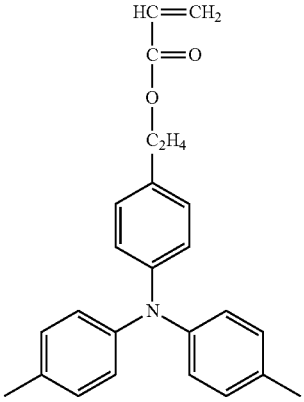
(5-4)
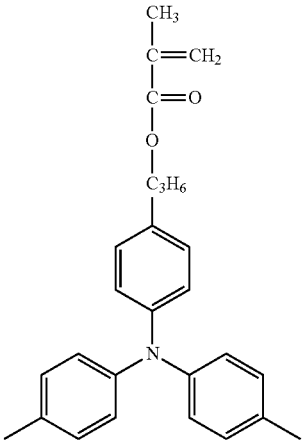
(5-5)
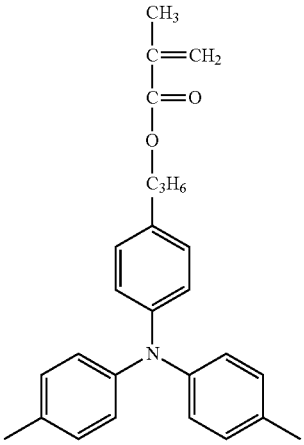
(6)
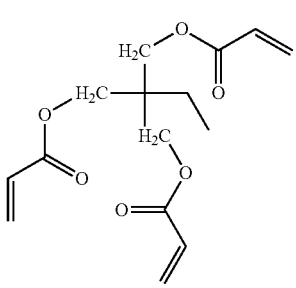

-continued (7)

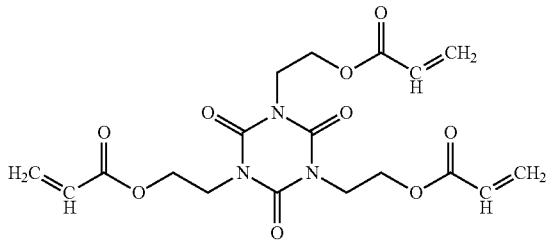

Comparative Example 2

A coating liquid for the protective layer according to the present comparative example was prepared in the same manner as the coating liquid for the protective layer according to Example 1, except that 9.6 parts of the compound represented by the formula (4-1) and 14.4 parts of the compound represented by the formula (5-1), which were used for the preparation of the coating liquid for the protective layer according to Example 1, were changed to 14.4 parts of the compound represented by the formula (4-1) and 9.6 parts of the compound represented by the formula (6), respectively. In addition, an electrophotographic photosensitive member according to the present Comparative Example was produced in the same manner as in Example 1, except that the protective layer was formed with the use of this coating liquid for the protective layer.

TABLE 1

| | Charge transport layer | | Protective layer | | | | |
|---|---|---|---|---|---|---|---|
| | Charge transporting substance | Content (% by mass) of charge transporting substance based on total mass of charge transport layer | Compound represented by formula (4) | Compound represented by formula (5) | % by mass of formula (5) based on total content of formula (4) and formula (5) | Compounds other than formula (4) and formula (5) contained in protective layer | Total content (% by mass) of formula (4) and formula (5) based on total mass of charge transport layer |
| Example 1 | (1-1)/(1-3) = 1/1 | 50 | (4-1) | (5-1) | 60 | — | 100 |
| Example 2 | (1-1)/(1-2) = 1/1 | 50 | (4-1) | (5-1) | 60 | — | 100 |
| Example 3 | (1-1)/(1-4) = 1/1 | 50 | (4-1) | (5-1) | 60 | — | 100 |
| Example 4 | (1-1)/(1-4)/(1-6) = 1/1/1 | 50 | (4-1) | (5-1) | 60 | — | 100 |
| Example 5 | (1-1)/(1-3) = 1/1 | 50 | (4-2) | (5-1) | 60 | — | 100 |
| Example 6 | (1-1)/(1-3) = 1/1 | 50 | (4-2) | (5-2) | 60 | — | 100 |
| Example 7 | (1-1)/(1-3) = 1/1 | 50 | (4-3) | (5-3) | 60 | — | 100 |
| Example 8 | (1-1)/(1-3) = 1/1 | 50 | (4-4) | (5-4) | 60 | — | 100 |
| Example 9 | (1-1)/(1-3) = 1/1 | 50 | (4-5) | (5-5) | 60 | — | 100 |
| Example 10 | (1-1)/(1-3) = 1/1 | 15 | (4-1) | (5-1) | 60 | — | 100 |
| Example 11 | (1-1)/(1-3) = 1/1 | 25 | (4-1) | (5-1) | 60 | — | 100 |
| Example 12 | (1-1)/(1-3) = 1/1 | 30 | (4-1) | (5-1) | 60 | — | 100 |
| Example 13 | (1-1)/(1-3) = 1/1 | 70 | (4-1) | (5-1) | 60 | — | 100 |
| Example 14 | (1-1)/(1-3) = 1/1 | 80 | (4-1) | (5-1) | 60 | — | 100 |
| Example 15 | (1-1)/(1-3) = 1/1 | 50 | (4-1) | (5-3) | 60 | (6) | 60 |
| Example 16 | (1-1)/(1-3) = 1/1 | 50 | (4-1) | (5-3) | 60 | (6) | 50 |
| Example 17 | (1-1)/(1-3) = 1/1 | 50 | (4-1) | (5-3) | 60 | (7) | 40 |
| Example 18 | (1-1)/(1-3) = 1/1 | 50 | (4-1) | (5-1) | 10 | — | 100 |
| Example 19 | (1-1)/(1-3) = 1/1 | 50 | (4-1) | (5-1) | 20 | — | 100 |
| Example 20 | (1-1)/(1-3) = 1/1 | 50 | (4-1) | (5-1) | 25 | — | 100 |
| Example 21 | (1-1)/(1-3) = 1/1 | 50 | (4-1) | (5-1) | 80 | — | 100 |

Comparative Example 1

A coating liquid for the protective layer according to the present Comparative Example was prepared in the same manner as the coating liquid for the protective layer according to Example 1, except that 9.6 parts of the compound represented by the formula (4-1) and 14.4 parts of the compound represented by the formula (5-1), which were used for the preparation of the coating liquid for the protective layer according to Example 1, were changed to 14.4 parts of the compound represented by the formula (5-3) and 9.6 parts of the compound represented by the formula (6), respectively. In addition, an electrophotographic photosensitive member according to the present Comparative Example was produced in the same manner as in Example 1, except that the protective layer was formed with the use of this coating liquid for the protective layer.

Comparative Example 3

A coating liquid for the protective layer according to the present Comparative Example was prepared in the same manner as the coating liquid for the protective layer according to Comparative Example 1, except that 9.6 parts of the compound represented by the formula (6), which was used for the preparation of the coating liquid for the protective layer according to Comparative Example 1, were changed to 9.6 parts of the compound represented by the following formula (8). In addition, the electrophotographic photosensitive member according to the present comparative example was produced in the same manner as in Example 1, except the protective layer was formed with the use of this coating liquid for the protective layer.

(8)

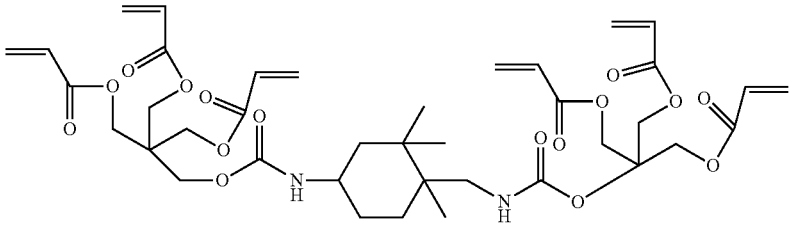

Comparative Example 4

A coating liquid for the charge transport layer according to the present Comparative Example was prepared in the same manner as the coating liquid for the charge transport layer according to Example 1, except that 5 parts of the compound represented by the formula (1-1) and 5 parts of the compound represented by the formula (1-3), which were used for the preparation of the coating liquid for the charge transport layer according to Example 1, were changed to 10 parts of the compound represented by the following formula (9).

(9)

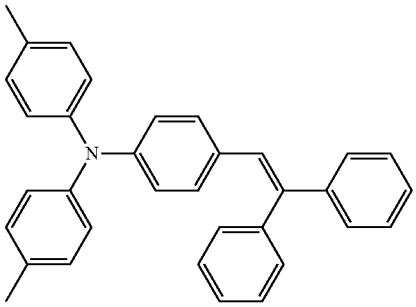

In addition, a coating liquid for the protective layer according to the present Comparative Example was prepared in the same manner as the coating liquid for the protective layer according to Example 1, except that 14.4 parts of the compound represented by the formula (5-1), which was used for the preparation of the coating liquid for forming the protective layer according to Example 1, were changed to 14.4 parts of the compound represented by formula (5-3).

An electrophotographic photosensitive member according to the present Comparative Example was produced in the same manner as in Example 1, except that the charge transport layer and the protective layer were formed with the use of the above coating liquid for the charge transport layer and the above coating liquid for the protective layer.

Comparative Example 5

A coating liquid for the charge transport layer according to the present Comparative Example was prepared in the same manner as the coating liquid for the charge transport layer according to Comparative Example 4, except that 10 parts of the compound represented by the formula (9), which was used for the preparation of the coating liquid for the charge transport layer according to Comparative Example 4, were changed to 10 parts of the compound represented by the following formula (10).

An electrophotographic photosensitive member according to the present Comparative Example was produced in the same manner as in Comparative Example 4, except that the charge transport layer was formed with the use of this coating liquid for the charge transport layer.

(10)

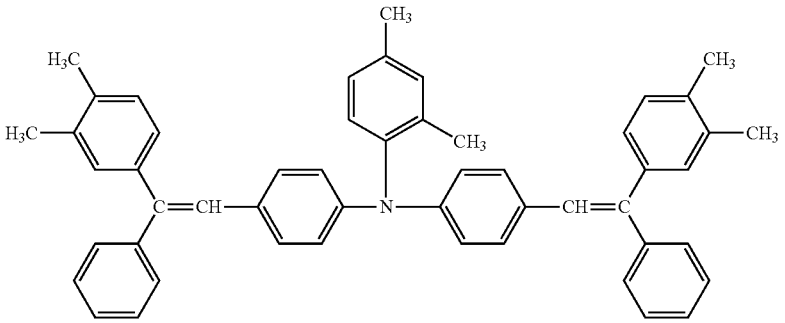

<Analysis>

The photosensitive members produced in Examples 1 to 21 and the photosensitive members produced in Comparative Examples 1 to 5 were used for analysis under the following conditions.

The surface of the obtained electrophotographic photosensitive member was scraped off with a razor, and the protective layer was obtained. This protective layer was subjected to 1H-NMR measurement (apparatus: AVANCE III 500 manufactured by Bruker Japan K.K.) and thermal decomposition gas chromatography measurement; and the percent by mass of the formula (3) based on the total content of the formula (2) and the formula (3), and the percent by mass of the charge transport portion based on the total mass of the protective layer were determined. The results are shown in Table 2.

<Evaluation>

Electric potential fluctuations were evaluated under the following conditions, with the use of the photosensitive members produced in Examples 1 to 16 and the photosensitive members produced in Comparative Examples 1 to 5.

As an electrophotographic apparatus, a laser printer (trade name: HP Laser Jet Enterprise Color M553dn; manufactured by HP Ink.) was used. However, the apparatus was altered so that the voltage to be applied to a charging roller could be adjusted and measured, and an amount of image exposure light could be adjusted and measured.

First, an image forming apparatus and the photosensitive member were left for 24 hours in an environment with a temperature of 15° C. and a relative humidity of 10%, and then the photosensitive members of Examples and Comparative Examples were each mounted on a cartridge of a cyan color, in the image forming apparatus.

As for an evaluation of the repeated use, images of a test chart with a printing ratio of 5% were continuously output onto 20,000 sheets of A4-size plain paper. Charging conditions were adjusted so that the dark portion potential became −600 V, and exposure conditions were adjusted so that the amount of the image exposure light became 0.4 μJ/cm$^2$.

The amounts of fluctuations of the light portion potential before and after the above repeated use were evaluated. The surface potential of the photosensitive member was measured with an altered cartridge in which an electric potential probe (trade name: model 6000B-8, manufactured by Trek Japan KK) was mounted at a development position. The electric potential was measured with the use of a surface potential meter (trade name: model 344, manufactured by Trek Japan KK). The evaluation results are shown in Table 2.

As is apparent from the results in Table 2, it can be understood that in the electrophotographic photosensitive members according to the Examples, electric potential fluctuations in the repeated use are suppressed.

TABLE 2

| | % by mass of formula (3) to total content of formula (2) and formula (3) | % by mass of charge transport portion to total mass of protective layer | Electric potential fluctuation [V] |
|---|---|---|---|
| Example 1 | 60 | 100 | 17 |
| Example 2 | 60 | 100 | 14 |
| Example 3 | 60 | 100 | 13 |
| Example 4 | 60 | 100 | 19 |
| Example 5 | 60 | 100 | 12 |
| Example 6 | 60 | 100 | 13 |

TABLE 2-continued

| | % by mass of formula (3) to total content of formula (2) and formula (3) | % by mass of charge transport portion to total mass of protective layer | Electric potential fluctuation [V] |
|---|---|---|---|
| Example 7 | 60 | 100 | 16 |
| Example 8 | 60 | 100 | 15 |
| Example 9 | 60 | 100 | 24 |
| Example 10 | 60 | 100 | 30 |
| Example 11 | 60 | 100 | 22 |
| Example 12 | 60 | 100 | 15 |
| Example 13 | 60 | 100 | 14 |
| Example 14 | 60 | 100 | 21 |
| Example 15 | 60 | 60 | 16 |
| Example 16 | 60 | 50 | 25 |
| Example 17 | 60 | 40 | 29 |
| Example 18 | 10 | 100 | 31 |
| Example 19 | 20 | 100 | 23 |
| Example 20 | 25 | 100 | 18 |
| Example 21 | 80 | 100 | 16 |
| Comparative Example 1 | 100 | 60 | 54 |
| Comparative Example 2 | 0 | 60 | 51 |
| Comparative Example 3 | 100 | 60 | 65 |
| Comparative Example 4 | 60 | 100 | 48 |
| Comparative Example 5 | 60 | 100 | 55 |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-024713, filed Feb. 14, 2019 which is hereby incorporated by reference herein in its entirety.

What is claimed is:

1. An electrophotographic photosensitive member, comprising:

a support, a photosensitive layer and a protective layer, in this order;

the photosensitive layer comprising a compound represented by formula (1)

(1)

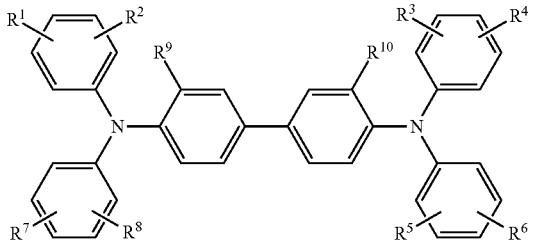

where $R^1$ to $R^{10}$ independently represent a hydrogen atom or a methyl group; and the protective layer being a cured film that is a polymerized product of a composition comprising radical polymerizable compounds consisting of a compound represented by formula (4) and a compound represented by formula (5)

(4)

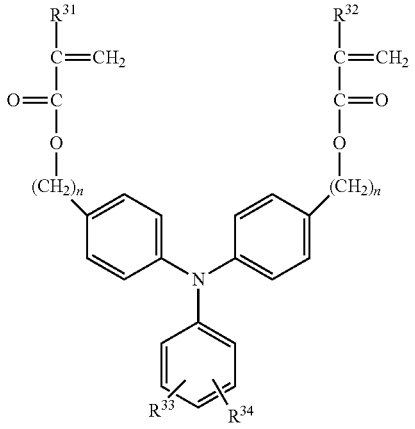

(5)

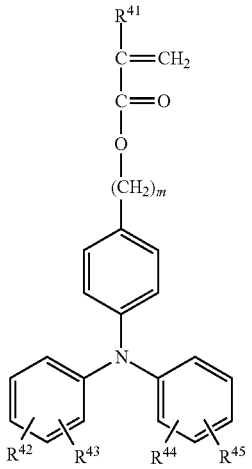

where $R^{31}$ to $R^{34}$ and $R^{41}$ to $R^{45}$ independently represent a hydrogen atom, a methyl group or an ethyl group, m is 2 to 5 and n is 2 to 5, wherein the only radical polymerizable compounds in the composition are the compound represented by formula (4) and the compound represented by formula (5).

2. The electrophotographic photosensitive member according to claim 1, wherein the photosensitive layer is a multilayer photosensitive layer in which a charge generation layer and a charge transport layer are layered in this order from the support, and the charge transport layer comprises the compound represented by formula (1).

3. The electrophotographic photosensitive member according to claim 2, wherein the compound represented by formula (1) is contained in the charge transport layer in an amount of 30 to 70% by mass based on a total mass of the charge transport layer.

4. The electrophotographic photosensitive member according to claim 1, wherein the photosensitive layer is a monolayer type photosensitive layer.

5. The electrophotographic photosensitive member according to claim 4, wherein the compound represented by formula (1) is contained in the photosensitive layer in an amount of 30 to 70% by mass based on a total mass of the photosensitive layer.

6. The electrophotographic photosensitive member according to claim 1, wherein $R^{31}$, $R^{32}$ and $R^{41}$ are all hydrogen atoms.

7. A process cartridge that is detachably attachable to a main body of an electrophotographic image forming apparatus, the process cartridge comprising:

an electrophotographic photosensitive member comprising a support, a photosensitive layer and a protective layer in this order; and at least one member selected from the group consisting of a charging member, a developing member and a cleaning member;

the photosensitive layer comprising a compound represented by formula (1)

(1)

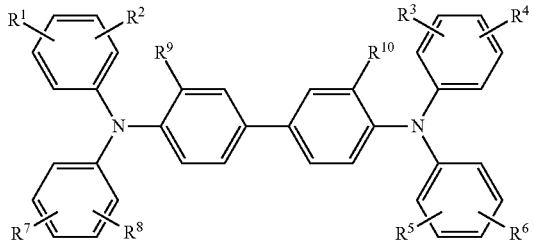

where $R^1$ to $R^{10}$ independently represent a hydrogen atom or a methyl group; and the protective layer being a cured film that is a polymerized product of a composition comprising radical polymerizable compounds consisting of a compound represented by formula (4) and a compound represented by formula (5)

(4)

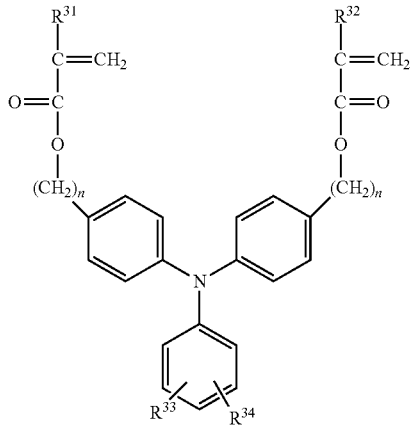

(5)

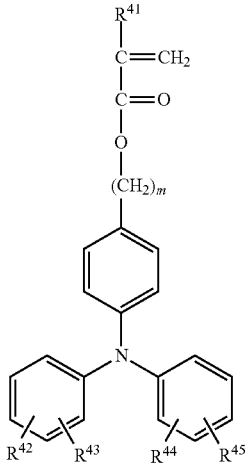

where $R^{31}$ to $R^{34}$ and $R^{41}$ to $R^{45}$ independently represent a hydrogen atom, a methyl group or an ethyl group, m is 2 to 5, and n is 2 to 5, wherein the only radical polymerizable compounds in the composition are the compound represented by formula (4) and the compound represented by formula (5).

8. An electrophotographic apparatus, comprising:

an electrophotographic photosensitive member, a charging apparatus, an exposure apparatus and a developing apparatus;

the electrophotographic photosensitive member comprising a support, a photosensitive layer and a protective layer in this order;

the photosensitive layer comprising a compound represented by formula (1)

(1)

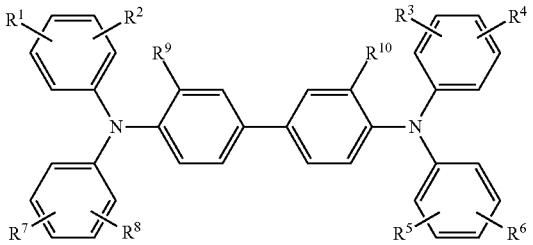

where $R^{1}$ to $R^{10}$ independently represent a hydrogen atom or a methyl group; and the protective layer being a cured film that is a polymerized product of a composition comprising radical polymerizable compounds consisting of a compound represented by formula (4) and a compound represented by formula (5)

(4)

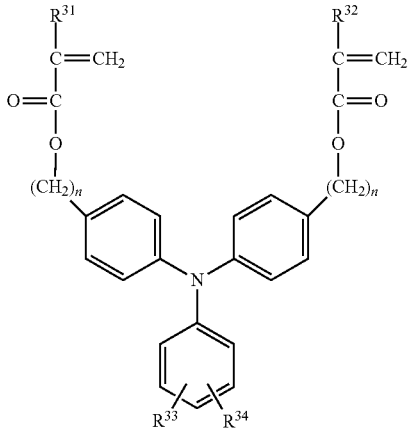

(5)

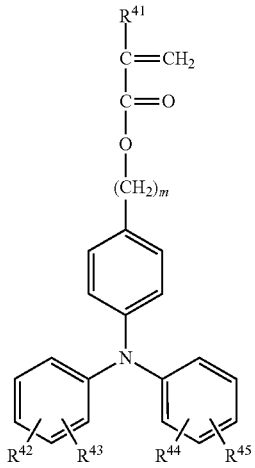

where $R^{31}$ to $R^{34}$ and $R^{41}$ to $R^{45}$ independently represent a hydrogen atom, a methyl group or an ethyl group, m is 2 to 5 and n is 2 to 5, wherein the only radical polymerizable compounds in the composition are the compound represented by formula (4) and the compound represented by formula (5).

* * * * *